US005489814A

United States Patent [19]

Banbury

[11] Patent Number: 5,489,814

[45] Date of Patent: Feb. 6, 1996

[54] FOCUSING MEANS FOR CATHODE RAY TUBES

[75] Inventor: John R. Banbury, Fleet, England

[73] Assignee: The Secretary of State for Defense in Her Britannic Majesty's Government of the United Kingdom of Great Britain and Northern Ireland, London, England

[21] Appl. No.: 108,743

[22] PCT Filed: Feb. 27, 1992

[86] PCT No.: PCT/GB92/00352

§ 371 Date: Sep. 3, 1993

§ 102(e) Date: Sep. 3, 1993

[87] PCT Pub. No.: WO92/16007

PCT Pub. Date: Sep. 17, 1992

[30] Foreign Application Priority Data

Mar. 5, 1991 [GB] United Kingdom ..... 9104649

[51] Int. Cl.[6] ..... H01J 29/48

[52] U.S. Cl. ..... 313/412; 313/414; 315/15; 315/16

[58] Field of Search ..... 313/412–414, 313/442, 447, 448, 449; 315/15, 16, 382, 382.1

[56] References Cited

U.S. PATENT DOCUMENTS

| | | | |
|---|---|---|---|
| 4,704,565 | 11/1987 | Blacker, Jr. | 315/382 |
| 4,897,575 | 1/1990 | Shimmoma | 315/15 |
| 5,113,112 | 5/1992 | Shimoma | 313/412 |
| 5,142,190 | 8/1992 | Koh | 313/414 |
| 5,157,301 | 10/1992 | Tominaga | 313/412 |

FOREIGN PATENT DOCUMENTS

| | | | |
|---|---|---|---|
| 0178857 | 4/1986 | European Pat. Off. | H01J 29/50 |
| 0235975 | 9/1987 | European Pat. Off. | H01J 29/50 |
| 0319328 | 6/1989 | European Pat. Off. | H01J 29/48 |
| 58-198819 | 11/1983 | Japan | H01J 9/20 |
| 59-90343 | 5/1984 | Japan | H01J 29/48 |

*Primary Examiner*—Michael T. Razavi
*Assistant Examiner*—Tuan V. Ho
*Attorney, Agent, or Firm*—Nixon & Vanderhye

[57] ABSTRACT

A cathode ray tube comprising a cathode (K) for emitting a beam of electrons; a grid (G) for controlling the intensity of the beam; three or more anodes (A1, A3, A4); a control for varying the potential of at least one of the anodes (A3) for focusing the beam to form a spot on a screen; and an additional, dynamic focus electrode (A2) maintained generally at a potential close to the cathode/grid potential. Suitable structure may be included for applying to said dynamic focus electrode a high frequency signal to provide a rapid focus control. Said dynamic focus electrode may comprise a plurality of circumferentially disposed segments and including applying a separate high voltage to each segment thus allowing the possibility of creating a quadruple action in conjunction with at least one adjacent electrode, said segments covered with a deposited high-resistance conducting film to prevent charging effects. Preferably the potential of the first anode (A1) is substantially greater than the controlling voltage range of the grid (G), the potential of the static focus electrode (A3), interposed between the first and final anodes, is substantially equal to or lower than that of the first anode; and the potential of the final anode (A4) is substantially higher than that of the first anode (A1).

11 Claims, 4 Drawing Sheets

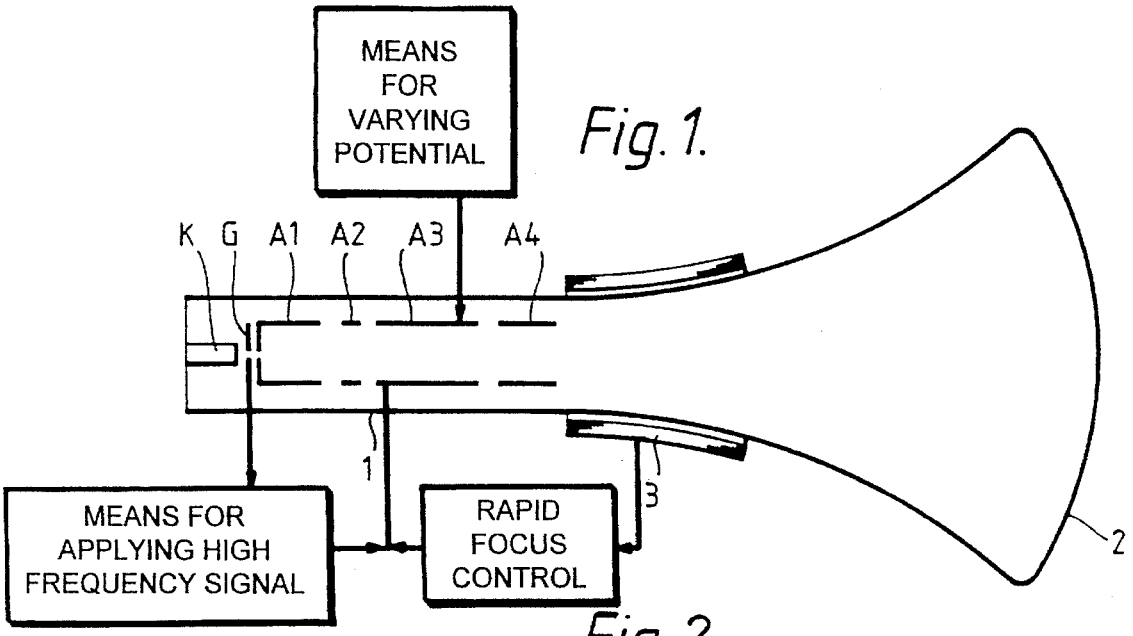
Fig. 1.
Fig. 2.
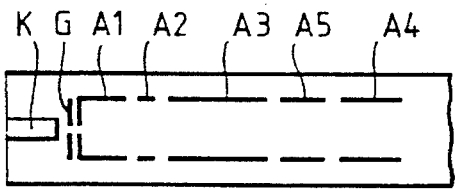
Fig. 3.
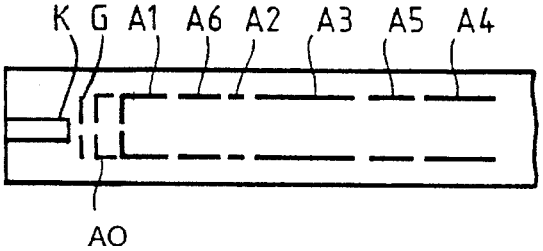
Fig. 4.
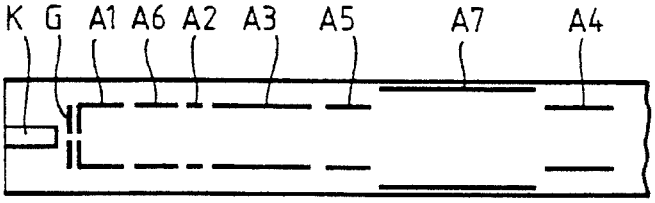

FOCUSING MEANS FOR CATHODE RAY TUBES

BACKGROUND OF THE INVENTION

1. Field of the Invention

This invention relates to means for focusing a beam of electrons which is generated by the cathode of a cathode ray tube (crt) and controlled by electrodes such as a grid and one or more anodes to form an image ("the spot") on a screen.

2. Discussion of Prior Art

A conventional means of achieving this is to provide an electrode whose potential, usually at a value of several kilovolts, is to some degree variable to accommodate variations, within manufacturing tolerances, in tube dimensions and positions of the components within the tube and, if need be, drift in power supply outputs which affect the potential applied to other electrodes.

While it is a relatively straightforward matter to provide means for such occasional variations in focus electrode potential, problems are encountered in providing means for a rapid and continuous variation in the high value potential, typically several kilovolts, normally applied to the focus electrode.

Such a variation would be necessary to provide a "dynamic focus" facility, i.e. to maintain a sharp focus when the spot is not only at the centre of the screen, but also at the periphery of the screen at the extremes of its raster scan. This facility is required especially in view of the trend towards flatter and squarer tubes, which although presenting a less distorted image to the viewer present rather greater problems in maintaining spot focus to the corners of the screen, and also in the use of high brightness tubes, such as those required for aircraft cockpit displays and the like, the electron beams in which have a reduced depth of focus.

SUMMARY OF THE INVENTION

The present invention is aimed at providing a high performance cathode ray tube which includes a low-aberration focusing lens having an electrode maintained at a sufficiently low potential to enable a high frequency dynamic focus signal to be applied to it by readily available and inexpensive means, for example through a high voltage FET.

According to this invention a cathode ray tube comprises: a cathode for emitting a beam of electrons; a grid For controlling the intensity of said beam; three or more anodes; and means for varying the potential of at least one of said anodes for focusing said beam to form a spot on a screen; characterised by an additional, dynamic focus electrode maintained generally at a potential close to the cathode/grid potential.

By "a potential close to the cathode/grid potential" is meant a voltage relative to the potential of the grid or of the cathode (one of which will usually, in practice, be maintained at earth potential), which is within the range of, For example, a high-voltage FET, i.e., within a few hundred volts compared with the typical several thousand volt potentials of the other anodes so that if need be it is a relatively straightforward matter to apply a high-frequency signal, such as that required for dynamic focus control, to the dynamic focus electrode.

The dynamic focus electrode preferably takes the form of a ring, having a diameter similar to that of the adjacent anodes and extending axially only a short distance compared with its diameter; if the electrode extends too far in an axial direction then its effect on electron trajectories may prevent the beam focusing at the screen distance, and also the potential within the electron beam may become low enough to result in unacceptable aberration levels.

The tube may include means for applying to said dynamic focus electrode a high frequency signal to provide a rapid focus control means.

Such a high frequency signal applied to the dynamic focus electrode may be arranged as a function of the position of the spot on the screen. In one application of the invention this may be achieved by means synchronized with or controlled by means for generating coil currents used for controlling a raster scan on the screen.

The signal applied to the dynamic focus electrode may also or alternatively be controlled by the means for controlling the grid-to-cathode potential difference (in practice, the means for controlling the grid potential or the cathode potential depending on the device, the other potential usually being fixed) in order to optimise the variation of focus with spot brightness; a signal having a frequency as high as several MHz may be required to accommodate variations in spot brightness both with time and with screen position.

The dynamic focus electrode may be in the form of a ring of unitary construction located symmetrically around the axis of the cathode ray tube, or it may be of segmented construction, according to its possible application.

Thus, in order to provide a dynamic focus facility, a simple ring or short cylinder is sufficient, this embodiment not requiring precision components and hence being the simplest to construct and assemble.

A two-segment split ring may be used to provide a spot-wobble facility.

A four-segment split ring may provide a stigmator with pre-aligned orientation, or precision electrostatic centre spot alignment. A particular application of a four-element ring is in connection with a precision in-line (PIL) three-gun colour tube, which has a tendency to produce an astigmatic beam profile with asymmetry in and perpendicular to the plane in which the three guns are located.

An eight-segment split Ping may provide an electrically-rotatable stigmator.

The spaces between the components of the split rings may be covered with a deposited high-resistance conducting film to prevent even and uneven (i.e., not rotationally symmetrical) charging effects. Alternatively, the ring or a coating thereon may be made of a high-resistance material, further coated with a conducting material to define the ring segments.

It will be appreciated that, by suitable connections from pairs or more of segments to common drive circuits, any higher number segmented ring can be made to fulfil the function of a lower number. This effect may also be achieved by electronic mixing of suitable input signals to individual segment voltage drivers.

Particularly in tubes employing a four- or an eight-segment split ring electrode, means may be provided for applying to the anode a high-frequency signal for dynamic correction of astigmatism, such a signal being, like the dynamic focus signal referred to above, a function of the position of the spot on the screen.

The focus electrodes, and the electrodes on either side of them, may incorporate non-rotationally symmetrical features to provide a quadrupole action, such as described, for example, by P. W. Hawkes and E. Kasper in Principles of Electron Optics, Volume 2, pages 810–813 (Academic Press, 1989) and by Klemperer and Barnett in Electron Optics, 3rd Edition, pages 221–224 (Cambridge University Press, 1971).

BRIEF DESCRIPTION OF THE DRAWINGS

By way of example, a number of embodiments of the invention will now be described with reference to the drawings, of which:

FIG. 1 is a schematic cross-section in an axial plane of the electron gun portion of a cathode ray tube constructed in accordance with the invention;

FIGS. 2, 3 and 4 are schematic diagrams of alternative electron guns within the scope of the invention;

DETAILED DISCUSSION OF PREFERRED EMBODIMENTS

Figure 5:
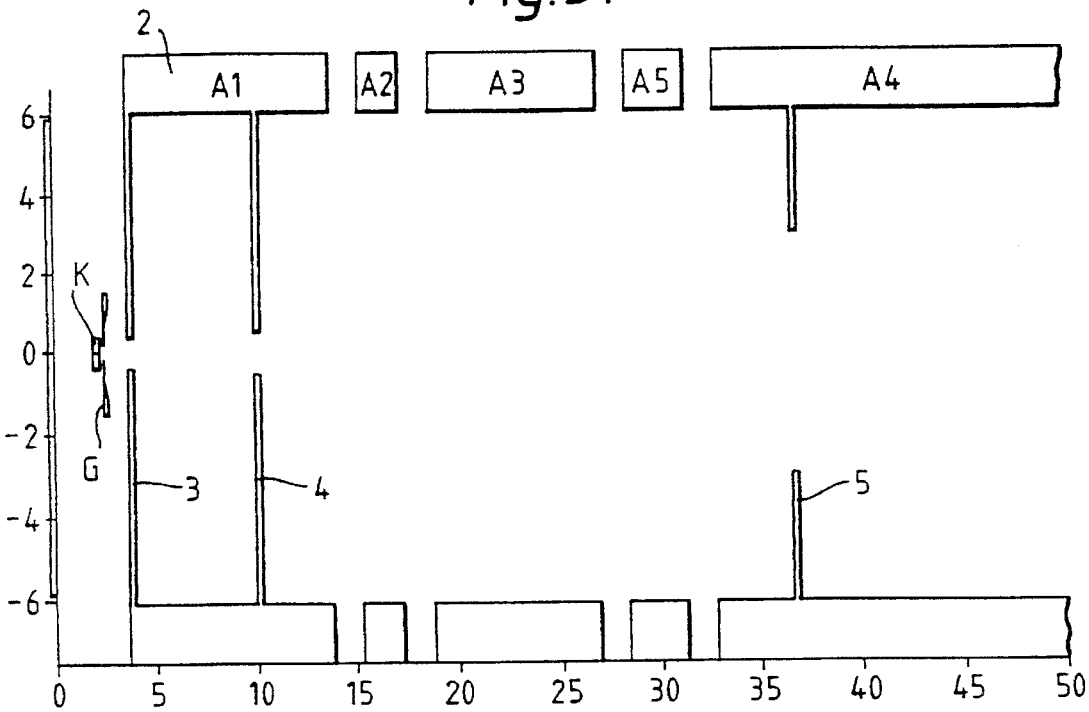
FIG. 5 is a schematic diagram illustrating in greater detail the electrode structure of the electron gun shown in FIG. 2.

With reference to FIG. 1, an electron gun is located within the neck portion 1 of a cathode ray tube for producing and focusing a beam electrons to form a spot on a screen 2. The tube typically includes coils 3 for generating an electromagnetic field by means of which the position of the spot on the screen is controlled. The gun comprises a cathode K, a grid G, and a focusing lens including a suitably shaped first anode A1, a short, dynamic focus electrode A2, a longer, static focus electrode A3 and a further anode A4.

This is a basic form of the invention, and is suitable for use in a miniature tube in which the internal diameter of the anodes can be 5 mm or less. Typical values of electrode potentials suitable for a 5 mm internal diameter gun are:

EXAMPLE 1

| | |
|---|---|
| K = +5 v to +80 v | A2 = 0 v |
| G = 0 v | A3 = +8.5 Kv |
| A1 = +10 Kv | A4 = +25 Kv |

Such a structure would be suitable for each of the three guns of a precision in-line ("PIL") colour tube, with a cathode to screen distance of about 250 mm. By substantially extending the gap between A3 and A4, the spot can be focused at a similar distance with a lower A1 voltage, e.g., +5 Kv.

In applications where a smaller cathode-to-screen distance is required (for example a sub-miniature crt having a spot size of about 20 microns, screen size of about 20 mm overall tube length 100 mm), reduced potentials would be used, with appropriate adjustments of the lengths of the electrodes where necessary.

The values given in this and the Following examples for A2 and A3 are typical values required to focus a screen-centred spot. In practice a range in potential of perhaps a few hundred volts would be provided to enable these electrodes to fulfil their focusing function.

An embodiment of the invention which is suitable for use with larger anodes (having a diameter of 12·2 mm, for example) as well as for the miniature type, and is also suitable for cathode ray tubes required to operate over a wide range of eht voltage, for example those of the "penetron" type, is shown in FIG. 2. The structure can be seen as a development of the FIG. 1 structure which, in order to provide a two-stage acceleration following A3, with reduced spherical aberration, includes an additional electrode A5, interposed between A3 and the final anode A4 and strapped to the first anode A1. This structure is capable of good aberration performance over a wide range of electrode potentials and of A4/A5 potential ratios, as is desirable in penetron tubes. Typical electrode potentials for a +25 Kv eht potential are as follows:

EXAMPLE 2

| | |
|---|---|
| K = v | A2 = 0 v |
| G = −20 v | A3 = +4.3 Kv |
| A1 = A5 = +5 Kv | A4 = +25 Kv |

For a final potential of +10 Kv in the same tube, the electrode potentials would be as follows, with the A3 potential changed to re-focus the spot at the lower eht voltage (A5 is electrically connected to A1 and remains at 5 Kv):

EXAMPLE 3

| | |
|---|---|
| K = 0 v | A2 = 0 v |
| G = −20 v | A3 = +1.5 Kv |
| A1 = A5 = +5 Kv | A4 = +10 Kv |

It should be noted that in all the examples, the abbreviations K, G, A1 etc are used to denote electrodes having generally equivalent functions within the electrode structure.

A form of gun having reduced aberrations but still suitable for use in a miniature tube is shown in FIG. 3. In this embodiment an additional focus electrode A6 has been interposed between the first anode A1 and the dynamic focus electrode A2 and is electrically strapped to the static focus electrode A3; this embodiment also includes the additional anode A5, strapped to A1, interposed between A3 and the final anode A4. Typical potentials are:

EXAMPLE 4

| | |
|---|---|
| K = +5 v to +80 v | A2 = 0 v |
| G = 0 v | A3 = A6 = +6.3 Kv |
| A1 = A5 = +10 Kv | A4 = +25 Kv |

It should also be noted that other developments of Example 1 are possible in which, for example, A6 is included and A5 is not, as well as vice versa.

A modification of the FIG. 3 arrangement is shown in FIG. 4. The basic electrode pattern remains, but a large gap is provided between the anode A5 and the final anode A4, the electric field in the gap being controlled by a high resistance conducting film A7 deposited on a rotationally-symmetric ring and electrically connected at its ends to A4 and A5.

In an alternative version of this embodiment, a similar high resistance film is deposited on a portion of a support structure for A5 and/or A4, the film being electrically connected at its ends as before to A4 and A5.

In the simple case, the voltage within the conducting film varies linearly with axial position resulting in a fairly uniform electric field between A5 and A4, but other arrangements producing a non-uniform field are possible.

This feature is especially beneficial where the potential difference between the final anode and the other electrodes is particularly high. Typical values of the electrode potentials of the embodiment illustrated in FIG. 4 are as follows:

EXAMPLE 5

| | |
|---|---|
| K = 0 v | A2 = 0 v |
| G = −20 v | A3 = A6 = +3.4 Kv |
| A1 = A5 = +5 Kv | A4 = +25 Kv |

In this example, the potential of the cathode K is shown as 0v. In all the embodiments illustrated it is essentially a matter of convenience whether the cathode or the grid G is maintained at or around earth. The grid—cathode voltage may in any case be very small compared with the grid—first anode voltage: in preferred embodiments of the invention the grid—first anode voltage is in one case at least twenty times, or in another case at least fifty times, the modulating range of the grid voltage in order to minimise variations in cross-over position with grid modulating voltage.

In another arrangement an extra accelerator electrode A8, maintained at a potential between that of A5 and A4, is placed between A5 and A4. Typical potential values of the electrodes in this arrangement are:

EXAMPLE 6

| | |
|---|---|
| K = 0 v | A2 = 0 v |
| G = −20 v | A3 = A6 = +4.4 Kv |
| A1 = A5 = +6.25 Kv | A4 = +25 Kv |
| | A8 = +12.5 Kv |

A disadvantage of this arrangement is that the extra electrode needs a separate voltage supply, albeit simply from an additional tapping from the eht transformer or from a potential divider across the supply to A4. The detailed dimensions of the various configurations and the performance achieved therewith will now be described with reference to FIG. 5, which shows in schematic form the electrode structure of FIG. 2 in greater detail, FIGS. 6 and 7 which illustrate the application of the FIG. 2 structure to Examples 2 and 3, and FIGS. 8, 9 and 10 which illustrate embodiments of Examples 4, 5 and 6 respectively.

FIGS. 6 to 10 show the anodes and computer-simulated equipotentials at 1 Kv intervals and electron trajectories for electrons diverging at a number of different, equispaced angles from the emission section (here drawn from a point source and computed to aid lens aberration assessment), in all cases on one side of the axis only.

With reference to FIG. 5, an electron gun consists of a cathode K, a grid G located a short distance in front of the emission surface of the cathode, and a first anode A1 comprising a main, generally cylindrical body 2 which supports two baffles 3 and 4. The function of the first baffle 3 is to provide the anode potential close to the axis at the desired grid-anode distance and hence define the grid-anode field, and the second baffle 4 provides a small beam-limiting aperture, in accordance with common practice (although baffle 4 would normally be omitted for triple-gun colour tubes). In the example illustrated, A1 extends axially for a distance of 10 mm beyond the first baffle 3 and its inside diameter in common with the other anodes, is 12·2 mm.

The structure also includes four further electrodes, each separated axially by a gap of about 1·5 mm, which consist in turn of a dynamic focus electrode A2, which is 2 mm long, a static focus electrode A3, which is 8 mm long, a second anode A5, which is 3 mm long, and a final anode A4. The final anode A4 includes a baffle 5 the purpose of which is to provide a "spray aperture" , i.e., to reduce the number of stray electrons reaching the screen and so improve contrast.

The electrodes may typically be machined cylinders, having a wall thickness in the order of 1 mm or, for example in a colour tube, three in-line structures may be made from pre-formed parts in accordance with established practice. Although shown square in the drawings, in practice the electrodes are polished and radiused to reduce field stress at the metal surfaces. The equipotential distribution is controlled primarily by the electrode potentials, their inside diameter and their length as measured between gap centres; the length of the gaps has a second order effect.

Figure 6:
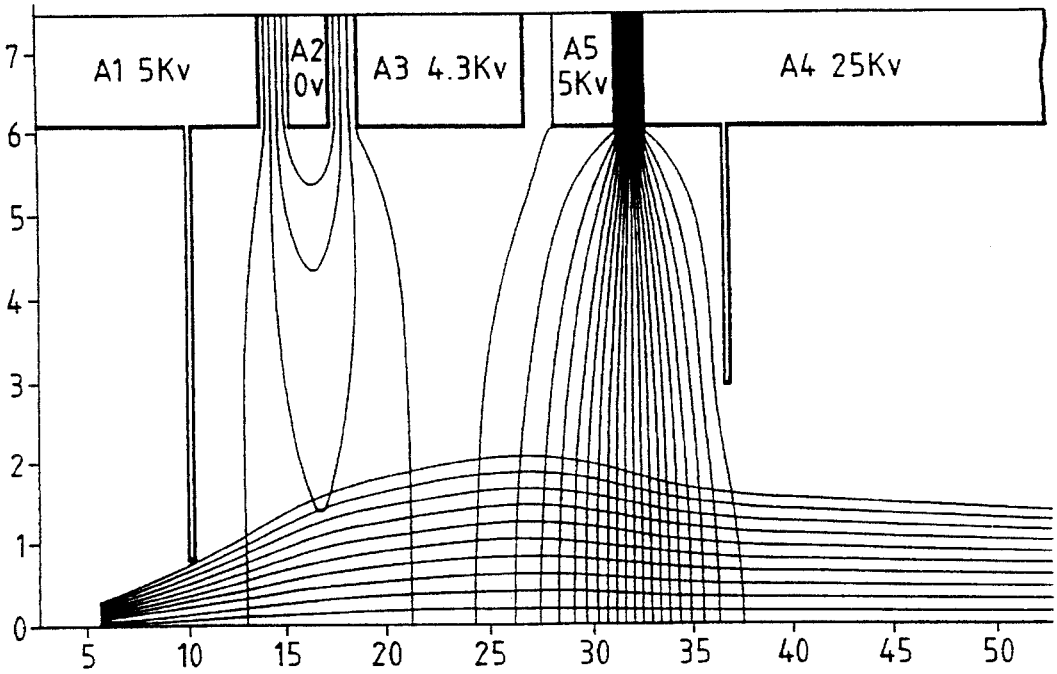
FIGS. 6 and 7 are sections, on one half of the axis only, of the electrode structure illustrated in FIG. 5, showing computer-simulated equipotentials and electron trajectories when two different sets of potentials are applied to the electrodes.
Figure 7:
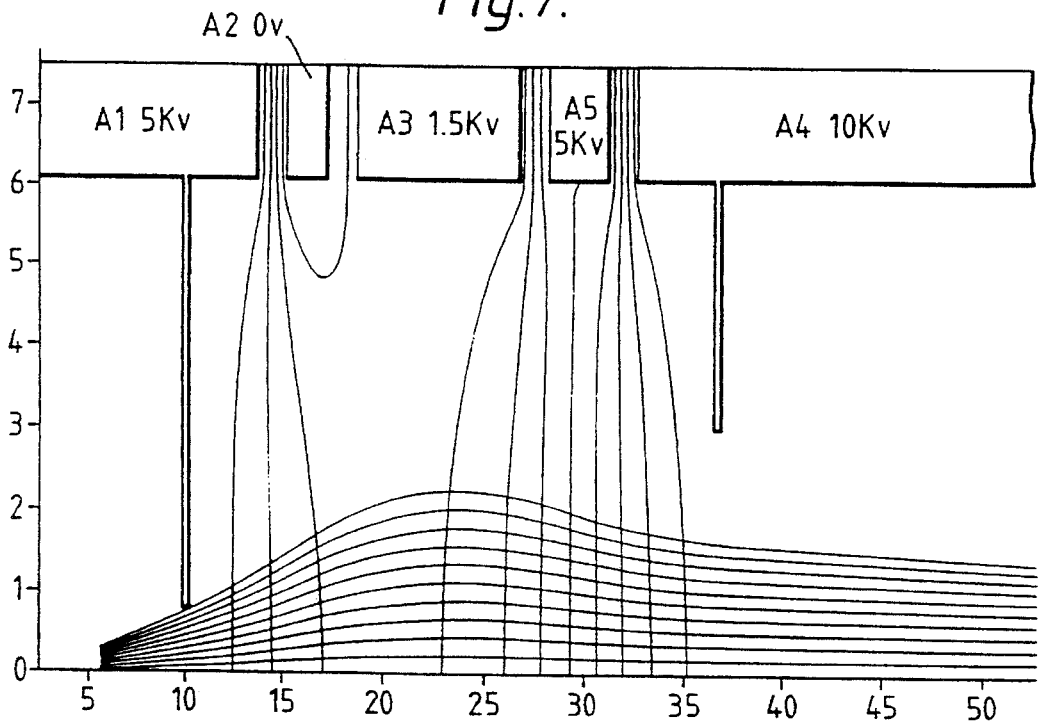

In FIGS. 6 and 7, the electrodes illustrated in FIG. 5 have been assigned the values listed above for Examples 4 and 5 respectively. The modification on the potential field within the anode structure due to the presence of even the narrow, earthy A2 is clear: the potential between the A1 zone and the A3 zone is reduced by A2 forming the initial focusing action of a five-electrode lens.

Figure 8:
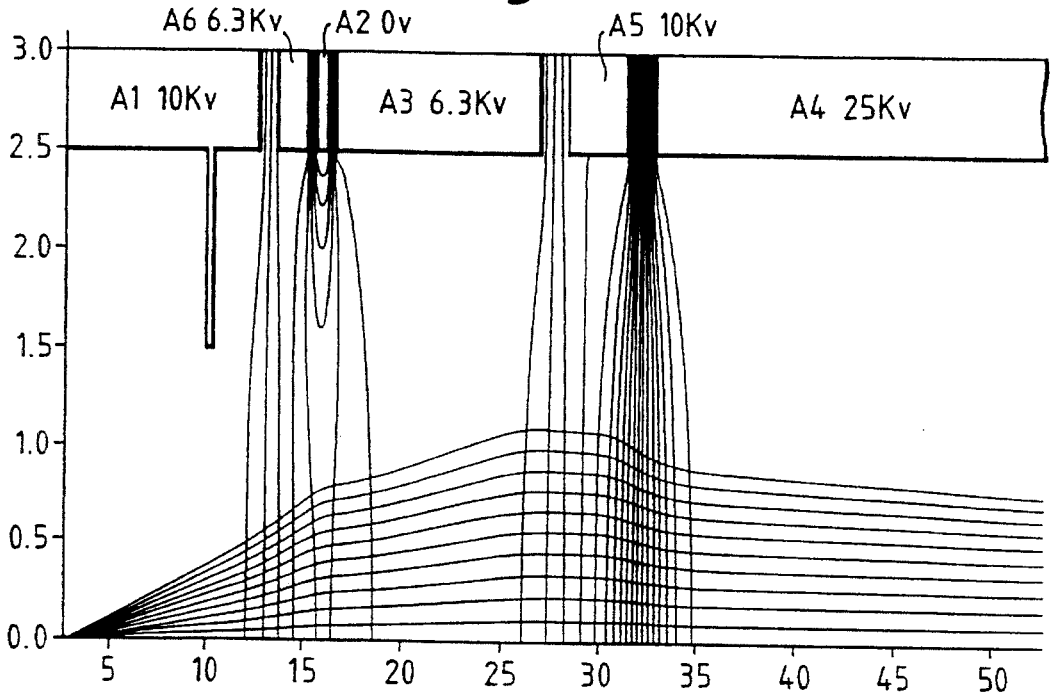
FIGS. 8, 9 and 10 are similar sections to FIGS. 6 and 7 showing respectively the results of computer simulations of three further embodiments of the invention.
Figure 9:
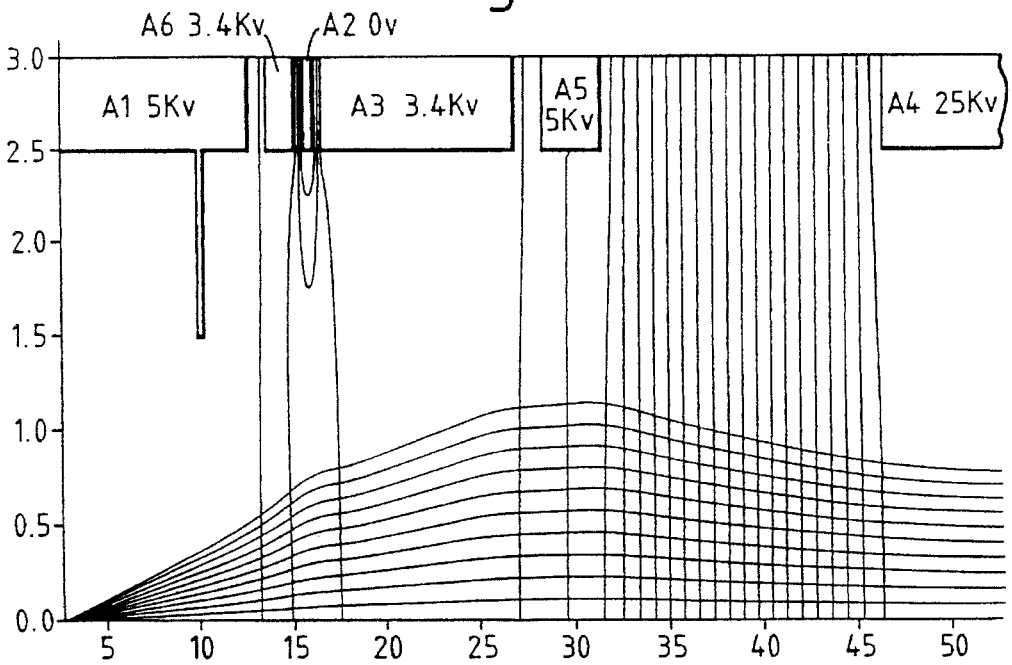
Figure 10:
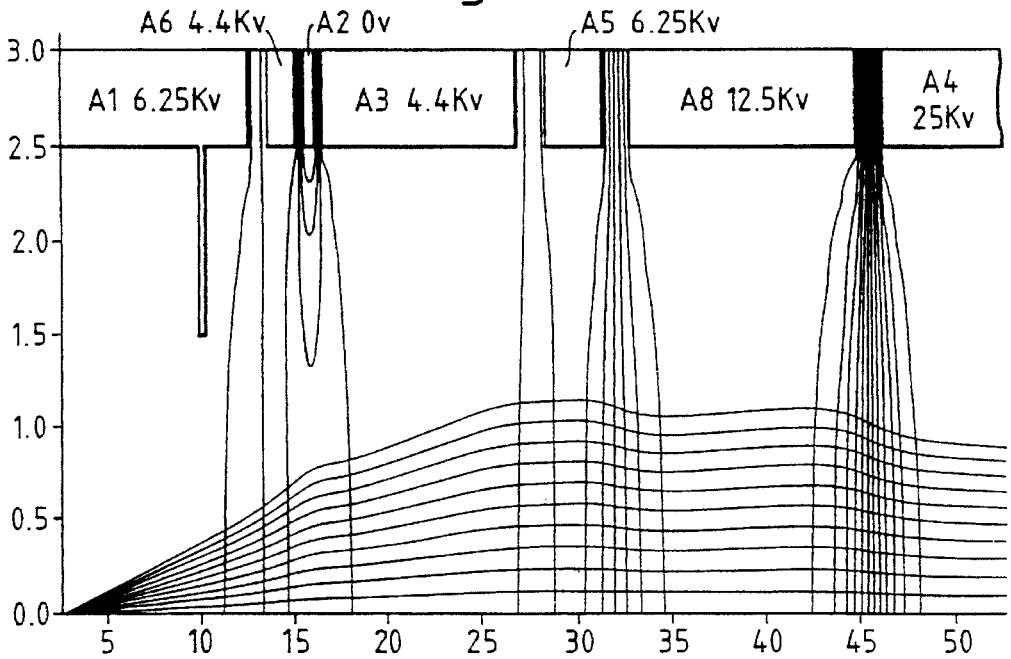

In the examples illustrated in FIGS. 8 to 10 the same effect is apparent: the presence of a narrow A2 at earth potential between A6 and A3, which are equal in potential and on either side of A2, provides an initial focusing action which is simple to control.

In all the examples illustrated, the good aberration performance, at least with regard to spherical aberration for an on-axis spot, is indicated by the nearly uniform spacing and tapering of the electron trajectories close to the right-hand edge of the figures (towards the closest approach to a single point on the screen).

Although the examples illustrated all include a first anode (A1) having a rather high potential, the invention is also applicable to electrode arrangements in which an additional electrode A0 is interposed between the grid G and the first anode A1 and maintained at a potential substantially higher than the maximum grid potential and substantially lower than the potential of the first anode, ie as in the first ("pre-focus") stage of a conventional bipotential lens configuration as shown in FIG. 3.

I claim:

1. A cathode ray tube comprising:

a cathode (K) for emitting a beam of electrons;

a grid (B) for controlling the intensity of said beam;

a first anode (A1) whose potential is higher than a controlling voltage range of a grid-to-cathode potential difference;

a final anode (A4) whose potential is higher than the potential of the first anode;

a static focus electrode (A3) interposed between said first and final anodes, said static focus electrode potential is lower than that of the first anode (A1);

a dynamic focus electrode (A2) located between the first anode (A1) and the static focus electrode (A3), all the electrodes from the dynamic focus electrode (A2) to the final anode (A4) inclusive including the static focus electrode (A3) being maintained at potentials which increase from that of the dynamic focus electrode (A2)

monotonically in accordance with their distance from the anode;

means for varying the potential of the static focus electrode (A3) in order to form a spot on a screen; and means for applying a high frequency control signal to the dynamic focus electrode (A2), the potential of the dynamic focus electrode (A2) being maintained at less than one thousand volts.

2. A cathode ray tube according to claim 1 wherein said means for applying comprises a rapid focus control means for varying the high frequency signal applied to the dynamic focus electrode (A2) as a function of the position of the spot on the screen.

3. A cathode ray tube according to claim 1, wherein said means for applying comprises means for varying the high frequency signal applied to the dynamic focus electrode (A2) as a function of the grid-to-cathode potential difference.

4. A cathode ray tube according to claim 1 including a first additional anode (A6) interposed between the first anode (A1) and the dynamic focus electrode (A2), the potential of all the electrodes from the first anode (A1) to the dynamic focus electrode (A2) inclusive including the first additional anode (A6) decreasing monotonically with their distance from the anode.

5. A cathode ray tube according to claim 4 in which the first additional anode (A6) and the static focus electrode (A3) are maintained at the same potential.

6. A cathode ray tube according to claim 1 including a second additional anode (A5) interposed between the static focus electrode (A3) and the final anode (A4).

7. A cathode ray tube according to claim 6 in which the second additional anode (A5) and the first anode (A1) are maintained at the same potential.

8. A cathode ray tube according to claim 6 including a structure (A7) located in the region of an extended gap between the second additional electrode (A5) and the final anode (A4) and electrically connected at its ends to said second additional electrode (A5) and final anode (A4) respectively, a high-resistance electrically-conducting film being deposited on the surface of said structure.

9. A cathode ray tube according to claim 1 including a third additional anode (A0) interposed between the grid (G) and the first anode (A1) and maintained at a potential higher than the maximum grid potential and lower than the potential of the first anode.

10. A cathode ray tube according to claim 1 in which the axial length of the dynamic focus electrode (A2) is less than the axial length of the static focus electrode (A3).

11. A cathode ray tube according to claim 1 in which the dynamic focus electrode (A2) is in the form of a ring whose axial length is less than its radius.

* * * * *